US005838104A

United States Patent [19]

Rutan et al.

[11] Patent Number: 5,838,104

[45] Date of Patent: Nov. 17, 1998

[54] SHIELD FOR HIGH PRESSURE DISCHARGE LAMPS

[75] Inventors: Douglas M. Rutan, Cleveland; Curtis E. Scott, Mentor; Jeannine A. Woyansky, Westlake; Katherine L. McGinnis, Kirtland, all of Ohio

[73] Assignee: General Electric Company, Schenectady, N.Y.

[21] Appl. No.: 148,020

[22] Filed: Nov. 4, 1993

Related U.S. Application Data

[63] Continuation of Ser. No. 806,803, Dec. 6, 1991, abandoned, which is a continuation of Ser. No. 539,638, Jun. 18, 1990, abandoned.

[51] Int. Cl.[6] ..... H01J 17/24

[52] U.S. Cl. ..... 313/560; 313/626; 313/240; 501/101

[58] Field of Search ..... 313/560, 25, 239, 313/240, 626; 501/101

[56] References Cited

U.S. PATENT DOCUMENTS

| | | | |
|---|---|---|---|
| 3,420,593 | 1/1969 | King | 313/560 |
| 3,931,536 | 1/1976 | Fohl et al. | 313/113 |
| 3,935,495 | 1/1976 | Scott, Jr. et al. | 313/25 |
| 3,979,633 | 9/1976 | Davis et al. | 313/560 |
| 4,137,484 | 1/1979 | Osteen | 313/25 |
| 4,221,993 | 9/1980 | Phillipp et al. | 315/73 |
| 4,285,732 | 8/1981 | Charles et al. | 501/101 |
| 4,333,032 | 6/1982 | Wyner et al. | 313/25 |
| 4,361,782 | 11/1982 | Reiling | 313/25 |
| 4,479,071 | 10/1984 | T'Jampens et al. | 313/25 |
| 4,580,075 | 4/1986 | Strok | 313/25 |
| 4,870,317 | 9/1989 | Dannert et al. | 313/25 |
| 4,906,887 | 3/1990 | Scholz et al. | 313/25 |
| 4,910,427 | 3/1990 | Aelterman et al. | 313/560 |
| 5,008,583 | 4/1991 | Carleton | 313/560 |

OTHER PUBLICATIONS

Getters for Lamps, E. Rabusin, ed., Saes Getters, S.p.A. —Milan, Italy, pp. 28–29.

Kohl, Walter; *Electron tubes :Materials and techniques.* pp. 128–129 1962.

*Primary Examiner*—Brian Zimmerman

*Attorney, Agent, or Firm*—Fay, Sharpe, Beall, Fagan, Minnich & McKee

[57] ABSTRACT

An improved compact, white color and pulse operated high pressure sodium vapor arc discharge lamp employing a radiation sensitive getter RF flashed onto the inner surface of the outer lamp envelope has a ceramic radiation shield interposed between the arc tube and getter.

20 Claims, 4 Drawing Sheets

SHIELD FOR HIGH PRESSURE DISCHARGE LAMPS

BACKGROUND OF THE INVENTION

This is a file wrapper continuation of application Ser. No. 07/806,803 now abandoned, filed Dec. 6, 1991, which in turn is a continuation of application Ser. No. 07/539,638, filed Jun. 18, 1990 now abandoned.

1. Field of the Invention

This invention relates to an improved shield for high pressure sodium vapor lamps and for metal halide lamps. More particularly, the present invention relates to a high pressure sodium vapor lamp useful for pulse operation and having improved color rendition which comprises a hermetically sealed, vitreous outer envelope enclosing within a light transmissive ceramic arc tube, a getter sensitive to heat or other radiation emitted by the arc tube and a ceramic disk located between the arc tube and getter which shields the getter from radiation emitted by the arc tube. The arc tube is hermetically sealed and contains a starting gas, an amalgam of mercury and sodium, and an electrode disposed within each end.

2. Background of the Disclosure

High pressure sodium vapor (HPSV) lamps are well known and used for street, roadway and area lighting. These lamps are similar in construction to that illustrated in FIG. 1 and comprise a vitreous, light transmissive outer envelope hermetically sealed and enclosing within an elongated, cylindrical arc tube, generally made of alumina or synthetic sapphire, mounted within said outer envelope so that its longitudinal axis is parallel with that of said outer envelope by suitable mounting means. The arc tube contains a fill of sodium and mercury along with an inert gas for starting the arc. The arc tube is also hermetically sealed and contains a pair of electrodes with one electrode disposed at each end and the electrode inleads being connected to suitable conductive members which pass through the hermetic seal of the outer envelope and are electrically connected to separate conductive portions of the lamp base for making contact with a source of electricity. These lamps invariably have a standard metal screw type base or a bi-pin base at one end.

Thus, turning to FIG. 1, high pressure sodium lamp 10 is schematically illustrated comprising vitreous, light transmissive outer envelope 12 having a conventional metal screw base 14 at one end and containing within a polycrystalline alumina or synthetic sapphire arc tube 16 mounted and supported within said envelope by means of support frame 18 connected at one end to inlead 20 which is hermetically sealed into arc tube 16 wherein it is connected to an electrode (not shown). Inlead 22 is hermetically sealed into arc tube 16 where it is connected to another electrode (not shown) at the other end of arc tube 15 and also to support wire 24. Wire 24 in turn is electrically connected by means of welding to support leg 26 at one end and at the other end is wrapped around ceramic insulating member 40. Support leg 26 and mount member 18 are electrically connected by welding to lamp inleads 28 and 30, respectively, which pass through a conventional pressed glass-to-metal hermetic seal 32 of envelope 12 and are connected (not shown) to separate metal portions 7 and 9 (separated by electrically insulative portion 5) of screw base 14 for making contact with a source of electricity. In this type of lamp construction it has become very common to use a metal such as barium as a getter for gettering trace quantities of oxygen, moisture and other components which are difficult to remove from within outer envelope 12 during lamp construction. The getter metal reacts with and/or binds these materials which would otherwise adversely affect lamp performance. Metals most commonly used include barium, tantalum, titanium, niobium, zirconium and their alloys. Sometimes more than one getter is used.

It is also common in such lamp construction to have one or more getter rings such as 38 and 38' which are small circular metal channel rings containing an alloy of, i.e., aluminum and barium. After the lamp envelope is sealed a radio frequency induction coil is placed outside of envelope 12 proximate each of said getter rings and energized, thereby causing the getter rings to be heated which vaporizes or flashes the getter metal (such as barium) causing it to deposit on the bottom interior surface of envelope 12 proximate the position of the getter ring, as a thin film of metal.

The use of a barium getter has been a cost effective means of providing efficient gettering in high pressure sodium vapor lamps. However, barium and other getters are sensitive to UV, visible and heat radiation emitted by the HPSV arc tube in that radiation in the infrared (IR) range (i.e., ~700–1600 nm) emitted by the arc tube causes the getter to evaporate to the vicinity of the arc tube and radiation in the UV and visible spectrum causes the getter to emit electrons which results in substantially reduced lamp life due to depletion of sodium from inside the arc tube which results from electrolysis which is exacerbated by the emitted electrons. U.S. Pat. No. 4,333,022 discloses that a metal getter such as barium disposed on the inner wall of the outer lamp envelope must be longitudinally spaced more than 1 centimeter from the end of the arc tube to minimize sodium depletion and concomitant short lamp life. Most metals will emit photoelectrons when subjected to radiation within the general range of from about 100–1600 nm. Accordingly, it has been found advantageous to employ a shield or barrier in the form of a metal disk 34 between the arc tube and getter which prevents heat and other radiation emitted by arc tube 16 from impinging on substantially most of the getter deposited on the inside walls of the outer envelope. In one known method, such a metal shield 34 merely consists of a round metal disk made of aluminum having a pair of holes through which pass support leg 26 and insulator 40 as is shown in FIG. 1. Insulator 40 is required to prevent shorting between conductive leads 24–26 and 18.

In a recent improvement in high pressure sodium vapor discharge lamps Osteen, in U.S. Pat. No. 4,137,484 has shown that these lamps can achieve a higher color temperature and thereby provide better color rendering if operated in a pulse AC or DC mode, than in normal 60 cycle AC operation. Osteen found that during a pulse there is considerable enhancement and broadening of the sodium lines at 449, 467, 498 and 568 nm, development of a continuum from 400 to 450 nm and also the appearance of visible mercury lines in lamps containing mercury in addition to sodium. Osteen found optimum results in lamps of from 50 to 1000 watts being obtained with pulse repetition rates ranging between 500 to 2000 Hz and at duty cycles of from 10 to 35%. He also found that operating HPSV lamps in a pulse mode could increase the color temperature from the common value of about 2050° K. experienced with conventional HPS vapor lamps, to about 2500° K. with little reduction in lamp efficacy. Newly developed, more compact HPSV lamps result in more heat generated within the lamp which is not as readily dissipated as in lamps having larger envelopes. This can cause excessive volatilization of the getter and also melt the solder used in the metal base. Similarly, in compact and high intensity metal halide arc discharge lamps the heat emitted by the arc tube can melt solder used in the metal bases of these lamps also, particularly when they are operated in a base-up position.

SUMMARY OF THE INVENTION

The present invention relates to high pressure arc discharge lamps comprising an arc tube within a vitreous outer envelope and a getter or a metal base at one end of the lamp, with an optically opaque, electrically nonconductive, heat insulative and thermally stable shield located between the arc tube and base or getter. Such lamps include HPSV lamps and metal halide lamps. In one embodiment the present invention relates to a high pressure sodium vapor (HPSV) lamp and particularly to a pulse operated HPSV lamp having good color rendition and a white light. Thus the present invention relates to an HPS vapor lamp operating in a pulse mode and having improved color rendition and high color temperature which comprises a hermetically sealed, light transmissive, vitreous outer envelope enclosing within (i) a light transmissive, hermetically sealed ceramic arc tube enclosing within an amalgam of sodium and mercury, an inert starting gas and a pair of electrodes in spaced apart relationship, (ii) a radiation sensitive getter, and (iii) an optically opaque, heat resistant and electrically insulative barrier or shield located within said outer envelope between said arc tube and said getter which shields said getter from radiation emitted by said arc tube, said lamp also having means for providing electricity to said electrodes. The arc tube has a wall thickness of at least about 0.9 mm.

HPSV lamps have been made according to this invention having a color temperature of about 2800° K. and with a color rendering index (CRI) of 70, compared to a color temperature of about 2100° K. and CRI of 20 for conventional HPSV lamps. This means that such lamps according to the present invention are capable of producing a high quality white light and good renditioning of the true color of objects.

In another embodiment the lamp will be a metal halide arc discharge lamp and the arc tube will comprise a hermetically sealed, vitreous, light transmissive material such as high purity fused silica (quartz) containing a pair of electrodes within and one or more metal halides. A shield according to the invention will be present within the outer envelope disposed between the arc tube and base to shield the base from heat emitted by the arc.

DETAILED DESCRIPTION

By radiation sensitive getter is meant a getter which is adversely effected by electromagnetic radiation throughout the visible and invisible spectrum (i.e., 100–1600 nm) which is emitted by the arc tube and which causes the getter to emit electrons, to evaporate, decompose into an undesirable material or to react with one or more lamp components or gases within said outer envelope, other than a gettering reaction with the trace quantities of oxygen, water vapor, carbon dioxide, nitrogen, etc., within said outer envelope for which purpose the getter is placed in the lamp initially. Barium or alloy thereof (i.e., with zirconium) is an illustrative, but non-limiting example of such a radiation sensitive getter useful in the practice of the present invention.

The heat shield, in addition to being electrically insulating and opaque to the electromagnetic radiation (including heat) emitted by the arc tube at least within the range of from about 100 to 1600 nm, should be thermally stable to withstand the high temperatures that can develop within the lamp and also be non-outgassing so as not to introduce contaminants into the outer envelope of the lamp. For example, many materials will, under vacuum and heat, give off compounds such as water, oxygen, hydrocarbons, etc., which are detrimental to the operation of the lamp. A preferred material is a sintered or machined ceramic disk and more preferably one that has been sintered to at least about 85% of its theoretical density, such as sapphire or a high purity type of alumina used to make arc tubes for HPS lamps. The shield will preferably be white in color, thus tending to reflect away radiation and shielding both a getter and a metal base from the radiation (including heat) emitted by the arc tube.

Figure 5:
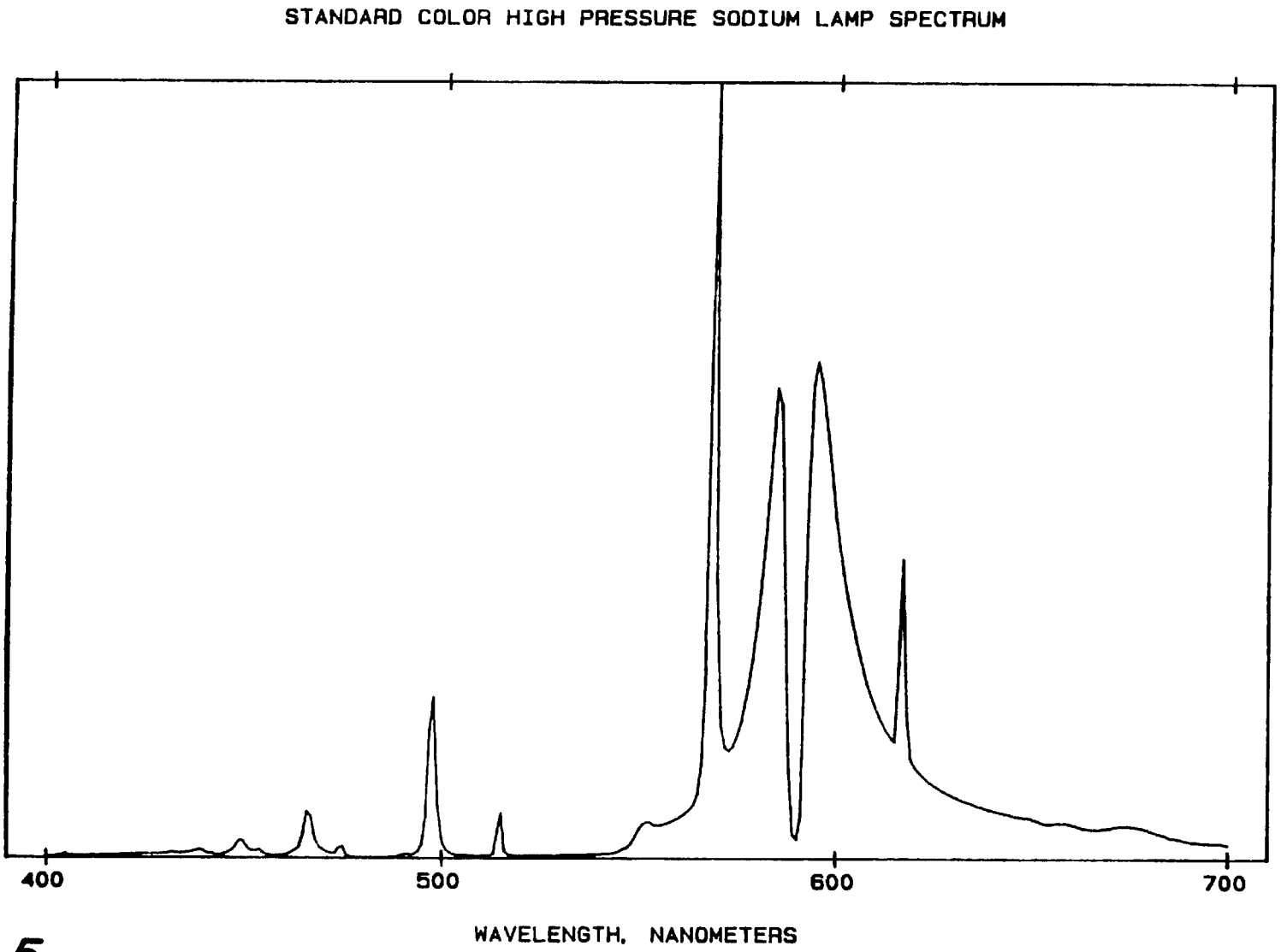
FIGS. 5 and 6 are graphs of the relative spectral light output distribution in the visible light region of a 100 watt conventional, unpulsed HPSV lamp according to the prior art (FIG. 5) and a pulse operated HPSV lamp according to the present invention (FIG. 6).
Figure 6:
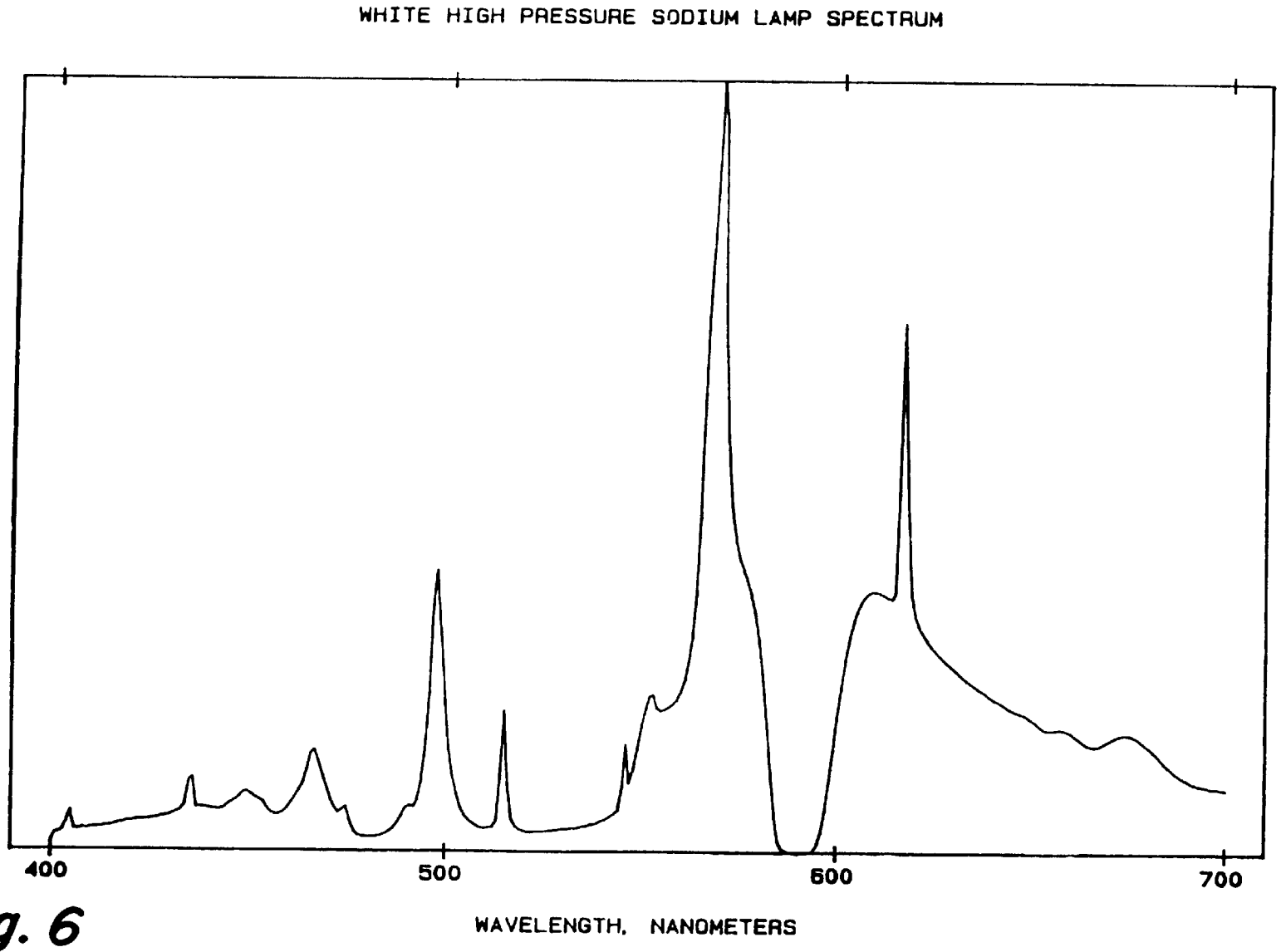

HPSV lamps according to one embodiment of the present invention have been made to operate in a pulse manner with either AC or DC pulses having a pulse current generally ranging from about 5 to 12 amperes, but which can go as high as 20 amperes, at a frequency ranging between about 120 to 2000 Hz and at a duty cycle of from about 10 to 35%. The frequency will preferably range from about 120–500 Hz. Although it is not absolutely necessary, it is preferred to maintain a small, residual current flowing between pulses sufficient to maintain the arc. In general this current will range from about 50 milliamps to about 1 ampere, depending on the wattage of the lamp. The high pulse currents produce a high sodium pressure in the arc tube during each pulse and, compared to a conventional HPS lamp which does not operate in a pulse mode, a substantially altered visible spectrum which results in a higher apparent color temperature in the range of from about 2500° K. to about 3200° K., and preferably at least about 2800° K. By way of example, a 100 watt conventional HPS lamp which is not operated in a pulse mode has an operating sodium pressure of about 50 torr for a 100 watt lamp. In contrast, a 100 watt lamp of the present invention has an operating sodium pressure of about 300 torr, which is a time averaged pressure. FIGS. 5 and 6 graphically illustrate the relative spectral output in the visible light range of such a 100 watt lamp of the prior art and a 100 watt lamp according to the present invention, respectively. Thus, referring to FIG. 6, one can see that with a 100 watt lamp of the present invention a continuum has developed in the spectrum at from about 400 to 585 nm, with considerable broadening at about 550–590 nm and 595–700 nm. The corrected color temperature of this lamp was about 2800° K. compared to about 2100° K. for the prior art lamp of FIG. 5 and 2500° K. of the Osteen lamp of U.S. Pat. No. 4,137,484.

The radiation shield must be electrically insulative not only to prevent arcing and shorting of the pulse current between the metal lamp leads, but also to enable the getter ring (in the case of an HPSV lamp) to be heated by an RF field to flash the getter. It has been found that if the shield is metal and within fairly close proximity (i.e., ≦5 mm) of the getter ring, the RF field lines will intersect the shield and the RF field will heat the shield and the getter will not be vaporized onto the envelope. Although this is not a substantial problem with non-compact HPSV lamps, it is a problem with the newer, more compact HPSV lamps. This problem of metal in close proximity to a getter ring is known to those skilled in the art and U.S. Pat. Nos. 4,906,887 and 4,910,427 disclose other methods employed in an attempt to overcome the problem.

Figure 1:
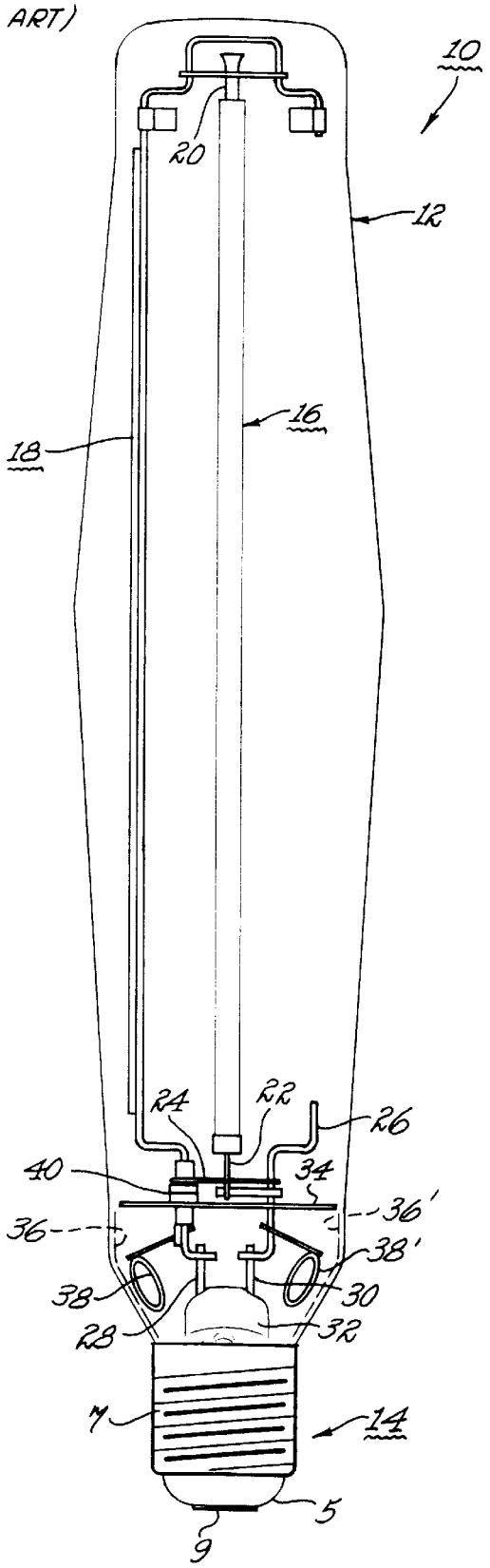
Fig. 1 (PRIOR ART)
FIG. 1 is a schematic illustration of an HPS lamp according to the prior art which employs a metal light shield for preventing light from the arc tube from impinging on a barium metal getter.
Figure 2:
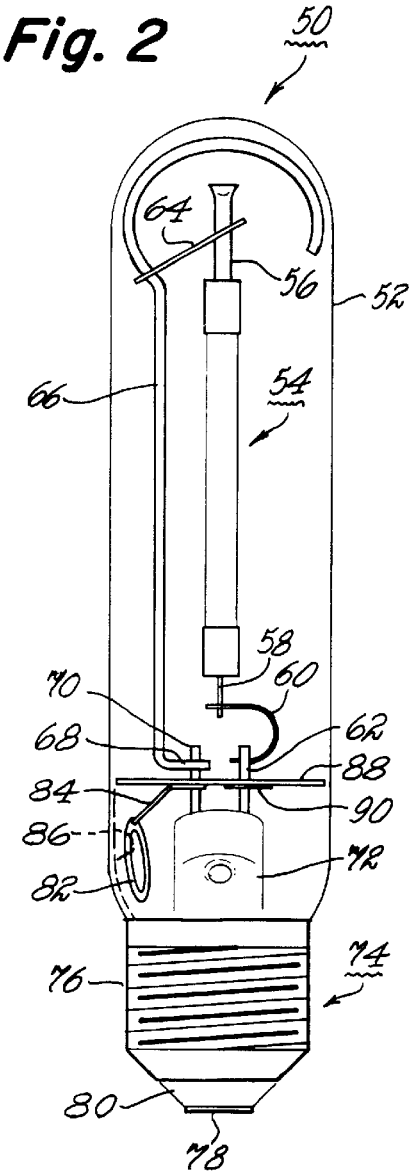
FIG. 2 is a schematic illustration of a lamp according to the present invention.
Figure 3:
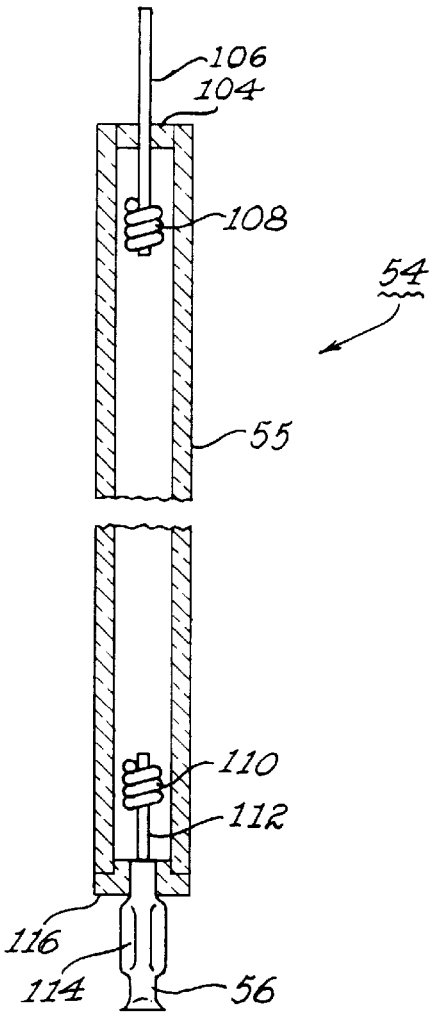
FIG. 3 schematically illustrates a polycrystalline alumina arc tube useful in the practice of the present invention.

Turning to FIG. 2, HPSV lamp 50 comprises vitreous outer envelope 52 enclosing elongated ceramic arc tube 54 within. Arc tube 54 is preferably made either of sintered polycrystalline alumina or of synthetic sapphire and contains an electrode (not shown) hermetically sealed and disposed within each end in spaced apart relationship as is shown in FIG. 3. Niobium tube 56 extends through one end of arc tube 54 and serves as both an inlead for the arc tube and a reservoir for storing excess sodium and mercury (not shown) contained within the arc tube. This type of arc tube construction is well known to those skilled in the art and is disclosed in greater detail, for example, in U.S. Pat. No. 4,065,691. The shank 58 of the other electrode extends past the end of the arc tube and is curved to form leg portion 60 which is conductively attached to a relatively heavy outer inlead conductor 62 by welding. Niobium tube 56 is conductively connected to wire support member 64 by welding, with the other end of 64 being welded to metal frame wire 66 which aids in positioning and supporting the arc tube within the vitreous outer envelope. Metal frame wire 66 in turn is electrically conducted to a second relatively outer inlead conductor 70 via a bend in the wire which forms horizontal leg 68. Outer inlead conductors 62 and 70 pass through the hermetic pressed glass-to-metal seal portion 72 of envelope 52 and are separately connected by means not shown to metal shell portion 76 and metal disk 78 of conventional metal screw base 74 in which one end of lamp 50 terminates. The conductive portions 76 and 78 of base 74 are separated and electrically insulated from each other by a glass or ceramic portion 80. Getter element 82 is a metal channel ring containing an alloy of barium and aluminum (not shown) and is held in position by means of support wire 84 which is curved to form leg portion 86 and is attached to outer inlead 70 by means of welding. After the lamp components have been assembled into envelope 52 and envelope 52 sealed, but before metal base 74 is attached, a radio frequency coil is positioned outside of envelope 52 in proximity to getter 82 and energized which causes getter ring 82 to heat up with the barium metal being evaporated and flashed onto the inner surface of envelope 52 as a very thin layer of metal 86. Getter ring 82 is positioned and tilted with the channel facing the lower inner wall portion of envelope 12 below shield 88 so that substantially all of the barium metal getter is deposited on the inside surface of said inner envelope 52 at a position between arc tube 54 and shield 88. Shield 88 also aids in ensuring that the flashed getter does not deposit above the shield in close proximity to the arc tube. The lamp shown in FIG. 2 is a compact lamp having an overall length of 4½ inches and a diameter of 1¼ inches. In this lamp shield 88 is between about 4–5 mm above getter ring 82. In contrast, in the lamp of FIG. 1, the overall length is about 15 inches having a maximum diameter of about 3 inches and with a distance from metal shield 34 to getter rings 38 and 38' of about 3 cm.

Figure 4A:
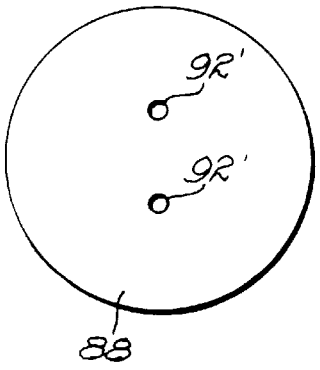
FIG. 4*a*–4*c* illustrate different embodiments of a ceramic disk useful as a radiation shield in lamps according to the invention.
Figure 4B:
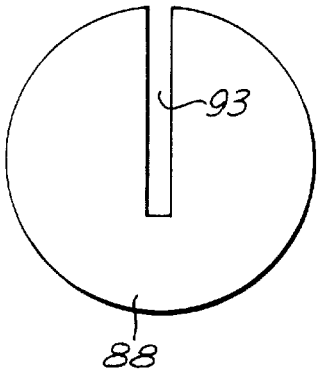
Figure 4C:
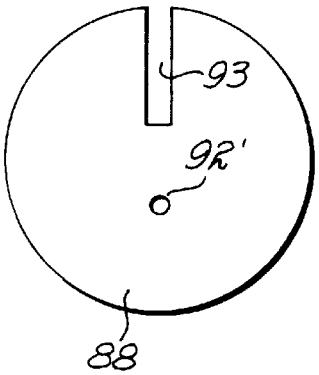

Radiation shield 88 is optically opaque, heat-resistant and thermally stable, electrically non-conductive and non-outgassing and in one embodiment is a ceramic disk made of sintered polycrystalline alumina, white in appearance and having two holes therethrough through which extend inleads 62 and 70 and is secured in place in lamp 50 by means of legs 68, 60 and 86 and also metal cross member 90 which is welded onto outer metal inlead 62 in order to complete the support for shield 88. Shield 88 is shown in greater detail in FIG. 4 and comprises a sintered polycrystalline alumina ceramic disk having a pair of holes 92 and 92' within so that it may be placed over outer inleads 62 and 70 during lamp construction. Shield 88 does not have to be constructed to exacting tolerances so as to contact the inner wall of outer envelope 52. Similarly, holes 92 and 92' do not have to be so precise as to be small enough so that no radiation whatsoever may pass through any space between the holes and inleads. It suffices that shield 88 protects the barium getter metal 86 from radiation and aids in ensuring that the getter is not deposited in closer proximity to the arc tube. As set forth above, radiation in the visible and invisible range will cause metals, including getter metals, to emit electrons which is believed to be detrimental to the operation of the lamp. Further, if the getter comprises barium or alloy thereof, heat or infrared radiation will also create problems in that the vapor pressure of barium sharply increases at a temperature of about 220° C. This will cause some barium to be evaporated as vapor within the lamp envelope wherein it will be in close proximity to the arc tube and exposed to radiation emitted from the arc tube, with concomitant loss in lamp life. FIGS. 4(*b*) and 4(*c*) illustrate other embodiments wherein one or both of holes 92' are replaced by slots 95 and 97. Shields useful in the present invention have been made about 1 mm thick of sintered polycrystalline alumina of from 94–96% $A1_2 0_3$ with the remainder being primarily $SiO_2$ and perhaps a minor amount of sintering aids.

Because the pressure of the sodium in arc tube 54 is relatively high during pulse lamp operation, the arc tube 54 must have substantially thicker walls than the walls of arc tubes found in conventional prior art HPS lamps. This is because the pulse current operation and high currents generate electromagnetic fields that promote migration of the sodium out of the arc tube due to electrolysis. FIG. 3 schematically illustrates an arc tube according to the prior art as compared to an arc tube and with a high color rendering, white light HPSV lamp of the present invention. It should be noted that the invention is not limited to this particular type of arc tube construction with respect to having the niobium lead 56, as will be appreciated and known by those skilled in the art. Thus, turning to FIG. 3(*a*), arc tube 100 is schematically illustrated comprising polycrystalline alumina tube 102 containing a mixture of sodium and mercury in an amount sufficient so that not all of the sodium is vaporized during operation of the lamp and wherein the vapor pressure of the sodium during lamp operation is in the range of from about 120–700 torr pressure, along with xenon as a starting gas present in the arc tube in an amount ranging between about 10–500 torr pressure. One end of arc tube 102 is sealed by means of an alumina ceramic sealing plug 104 through which extends inlead 106 which supports tungsten electrode 108 containing a suitable electron emission mix, such as dibarium calcium tungstate between its turns. Tungsten electrode 10 also having an emission mix between its turns is supported on shank 112 which projects into reservoir tube 56 and is secured in place therein by crimping the niobium metal reservoir tube 56 at location 114. Tube 56 projects through and is sealed into alumina sealing plug 116. Both of the sealing plugs 104 and 116 are secured in place by a suitable sealing frit the compositions and use of which are well known to those skilled in the art. The wall thickness of conventional, prior art HPS lamp arc tubes generally ranges between about 0.50 to 0.80 mm, with 0.75 mm being a nominal thickness. In marked contrast, in the arc tube of the present invention, the wall thickness will be at least about 0.9 mm ranging from about 0.9 to 1.8 mm and preferably from 1.0 to 1.2 mm in thickness. Arc tubes used in lamps in the practice of this invention have been made according to U.S. Pat. No. 4,285,732 with an additional sintering step (sintered twice) in order to promote growth of the alumina crystals and then chemically polished according to U.S. Pat. No. 3,935,495.

While the foregoing has been with respect to HPSV lamps, it will be appreciated that the same considerations and illustrations apply to metal halide arc discharge lamps with respect to using the shield of the present invention in such lamps to protect the lamp base and socket into which the base is inserted or screwed from excessive heat, particularly when the lamp is operated in a base-up position. As set forth previously, such heat can melt the solder employed in the construction of lamp bases and also destroy the insulation of the wires employed in lamp sockets leading to electrical shorts and fires. Metal halide lamps employing metal heat shields are known to those skilled in the art and are disclosed, for example in U.S. Pat. Nos. 4,361,782 and 4,221,993. The lamps in these disclosures have aluminum disks press fit over the glass stem press seal of the glass outer envelope inside the envelope between the base and metal halide arc tube. The shield of the present invention in such lamps will avoid the danger of electrical shorting. U.S. Pat. No. 4,914,345 discloses typical conventional metal screw base construction used with lamps. Finally, the shield of this invention will also be useful with the newer electrodeless discharge types of lamps such as is disclosed, for example, in U.S. Pat. No. 4,894,591.

The invention will be more readily understood by reference to the following example:

EXAMPLE

HPSV lamps according to an embodiment of the present invention were made as illustrated in FIG. 2 and described under DETAILED DESCRIPTION in a 95 watt nominal size rating having a clear glass outer envelope with a diameter of about 32 mm and an overall length of about 133 mm enclosing an arc tube. The arc tube was about 83 mm long having an arc length of about 23 mm within. The arc tube inner diameter was 5.5 mm and had a wall thickness of 1.05 mm. The arc tube contained a xenon starting gas at a fill pressure of about 15 torr and contained 45 milligrams of a sodium-mercury amalgam containing 25 wt. % sodium. A barium getter was employed along with a polycrystalline alumina ceramic radiation shield as shown in FIGS. 2 and 4(*a*) having a thickness of about 1 mm. The getter was RF flashed from a getter ring containing an alloy of barium and aluminum as shown in FIG. 2. The arc tube was also made as set forth in the DETAILED DESCRIPTION being sintered twice and then chemically polished as previously described. The arc gap was 23 mm. These lamps were operated employing current pulses of 7.5 amperes at a frequency of 300 Hz and a duty cycle of 17% in AC operation, with a current between pulses of only 100 milliamperes. These lamps produced a color temperature of 2800° K. with a CRI of 70 and a light output of 5200 lumens. The time averaged operating sodium pressure was 300 torr. FIG. 6 illustrates the spectral output of these lamps within the visible light region of from about 400–700 nm.

What is claimed is:

1. A high pressure sodium vapor arc discharge lamp which comprises a hermetically sealed, light transmissive, vitreous outer envelope containing (i) a light transmissive, hermetically sealed ceramic arc tube enclosing within an amalgam of sodium and mercury, an inert starting gas and a pair of electrodes in spaced apart relationship, (ii) a getter sensitive to radiation emitted by said arc tube, said getter having been flashed from a getter containing ring onto said envelope by means of RF flashing, and (iii) an optically opaque, heat-resistant and electrically insulative alumina shield located within said outer envelope between said arc tube and said getter which shields said getter from radiation emitted by said arc tube and which is located close enough to said getter ring and in a manner such that it would have interfered with said RF flashing of said getter if it had been electrically conductive, said lamp also having means for providing electricity to said electrodes.

2. The lamp of claim 1 wherein said shield is located within about 5 mm of said getter ring.

3. The lamp of claim 2 wherein said alumina shield comprises sintered alumina having a density of at least about 85% of aluminum oxide.

4. A high pressure sodium vapor lamp which operates in a pulse mode and which comprises a hermetically sealed, light transmissive, vitreous outer envelope enclosing within (i) a light transmissive, hermetically sealed ceramic arc tube containing an amalgam of sodium and mercury, an inert starting gas and a pair of electrodes in spaced apart relationship, (ii) a getter sensitive to radiation emitted by said arc tube, said getter having been flashed from a getter containing device onto said envelope by means of RF flashing, and (iii) an optically, opaque, heat-resistant and electrically insulating alumina shield located within said outer envelope between said arc tube and said getter which shields said getter from radiation emitted by said arc tube and which is located close enough to said getter containing device and in a manner such that it would have interfered with RF flashing of said getter from said getter containing device onto said envelope if it had been electrically conductive, said lamp also having means for providing electricity to said electrodes.

5. The lamp of claim 4 wherein said shield is located within about 5 mm of said getter device.

6. The lamp of claim 5 wherein said shield comprises sintered alumina having a density of at least about 85% of aluminum oxide.

7. The lamp of claim 5 wherein the operating sodium pressure of said sodium within said arc tube is between about 120–700 torr.

8. The lamp of claim 7 wherein said shield is a disk.

9. A high pressure sodium vapor lamp which operates in a pulse mode at a frequency of from about 120 to 2000 Hz and at a duty cycle of from about 10 to 35% and which comprises a hermetically sealed, light transmissive, vitreous outer envelope enclosing within (i) a sodium containing light transmissive, ceramic arc tube, (ii) a getter sensitive to radiation emitted by said arc tube, said getter having been flashed from a getter ring onto said outer envelope by means of RF flashing, and (iii) an optically opaque, heat-resistant and electrically insulative alumina disk as a barrier or shield located within said outer envelope between said arc tube and said getter which shields said getter from radiation emitted by said arc tube and which is located close enough to said getter ring and in a manner such that it would have interfered with RF flashing of said getter from said ring onto said envelope if it had been electrically conductive, said lamp also having means for providing electricity to said electrodes.

10. The lamp of claim 9 wherein said disk is located within about 5 mm of said getter ring.

11. The lamp of claim 10 wherein said alumina is made of sintered alumina having a density of at least about 85% of aluminum oxide.

12. The lamp of claim 10 wherein the operating sodium pressure of said sodium within said arc tube is between about 120–700 torr.

13. The lamp of claim 12 wherein the thickness of said arc tube is at least about 0.9 mm.

14. The lamp of claim 3 wherein said shield is white.

15. The lamp of claim 1 wherein said getter comprises barium.

16. The lamp of claim 4 wherein said shield is white.

17. The lamp of claim 4 wherein said getter comprises barium.

18. The lamp of claim 9 wherein said shield is white.

19. The lamp of claim 9 wherein said getter comprises barium.

20. The lamp of claim 19 wherein said shield is white.

* * * * *